US005553333A

United States Patent [19]

Andersson

[11] Patent Number: 5,553,333

[45] Date of Patent: Sep. 10, 1996

[54] PRESSURIZED WATER CLOSET FLUSHING SYSTEM

[76] Inventor: Sven E. Andersson, 203 Yoakum Pkwy., Bldg. 1–221, Alexandria, Va. 22304

[21] Appl. No.: 292,429

[22] Filed: Aug. 17, 1994

Related U.S. Application Data

[63] Continuation-in-part of Ser. No. 129,966, Sep. 30, 1993.

[51] Int. Cl.[6] ..... E03D 3/04; E03D 3/10

[52] U.S. Cl. ..... 4/354; 4/361; 4/362; 4/379; 4/407

[58] Field of Search ..... 4/354, 359, 360, 4/361, 362, 332, 379, 330, 407, 388

[56] References Cited

U.S. PATENT DOCUMENTS

| | | | |
|---|---|---|---|
| 769,525 | 9/1904 | Adams . | |
| 859,341 | 7/1907 | Scheier | 4/359 |
| 880,594 | 3/1908 | Stickdorn . | |
| 932,716 | 8/1909 | Murray . | |
| 1,598,743 | 9/1926 | Paul | 4/361 |
| 2,286,896 | 6/1942 | Carrillo . | |
| 2,502,262 | 3/1950 | Labiche . | |
| 2,510,910 | 6/1950 | Schulpen . | |
| 2,629,878 | 3/1953 | De Witt . | |
| 2,918,680 | 12/1959 | Langdon . | |
| 2,957,181 | 10/1960 | Lamping . | |
| 2,966,044 | 12/1960 | Mitchell . | |
| 3,029,443 | 4/1962 | Naccarato . | |
| 3,149,344 | 9/1964 | Langdon . | |
| 3,378,855 | 4/1968 | Springer . | |
| 3,553,739 | 1/1971 | Owens . | |
| 3,555,571 | 1/1971 | Gibbs et al. . | |
| 3,605,125 | 9/1971 | Gibbs et al. . | |
| 3,628,195 | 9/1971 | Skousgaard | 4/26 |
| 3,677,294 | 7/1972 | Gibbs et al. | 137/572 |
| 3,792,497 | 2/1974 | Robbins | 4/26 |
| 3,813,701 | 6/1974 | Stevens | 4/26 |
| 3,817,279 | 6/1974 | Larson . | |
| 3,817,286 | 6/1974 | Caron et al. | 137/628 |
| 3,817,489 | 6/1974 | Caron et al. | 251/38 |
| 3,820,171 | 6/1974 | Larson | 4/31 |
| 3,820,754 | 6/1974 | Caron et al. | 251/38 |
| 3,890,651 | 6/1975 | Wood | 4/26 |
| 4,060,857 | 12/1977 | Couton | 4/26 |
| 4,115,883 | 9/1978 | Dauvergne | 4/353 |

(List continued on next page.)

FOREIGN PATENT DOCUMENTS

| | | | |
|---|---|---|---|
| 127331 | 1/1902 | Germany | 4/362 |
| 38622 | 8/1909 | Germany | 4/354 |
| 166766 | 9/1950 | Germany | 4/361 |
| 3220951 | 4/1983 | Germany | 4/354 |
| 82823 | 3/1935 | Sweden | 4/361 |

*Primary Examiner*—Henry J. Recla
*Assistant Examiner*—Charles R. Eloshway
*Attorney, Agent, or Firm*—Workman, Nydegger & Seeley

[57] ABSTRACT

An apparatus for flushing a water closet bowl includes a pressurizable reservoir, within which is formed a primary and a secondary pressure zone. Formed at the bottom of the reservoir is an exit aperture through which the pressurized fluid is discharged into the bowl. Movably disposed within the reservoir is an elongate piston member. Formed at the top of the piston member is a hollow cup, which is movably disposed within a downwardly extending hollow cylinder within which is formed the secondary pressure zone. Formed at the bottom of the piston is a plug which seals the exit aperture. During a flushing action, pressure within the secondary pressure zone is released by operating a flushing lever, and the piston moves upwardly so as to release the plug from the exit aperture. In one embodiment, the flushing apparatus includes a fluid inlet regulator that controls the amount of fluid that is introduced into the reservoir from a fluid supply line. The inlet regulator also includes a back flow prevention mechanism which prevents fluid from reentering the fluid supply line in the event of a negative pressure therein. In another embodiment the flushing apparatus includes an overpressure protection mechanism formed within the piston.

21 Claims, 8 Drawing Sheets

U.S. PATENT DOCUMENTS

| | | | |
|---|---|---|---|
| 4,142,262 | 3/1979 | Hamilton | 4/354 |
| 4,143,433 | 3/1979 | Skousgaard | 4/354 |
| 4,183,108 | 1/1980 | Hamilton | 4/354 |
| 4,232,409 | 11/1980 | Van Pham | 4/362 |
| 4,232,698 | 11/1980 | Hosterman et al. | 137/68 |
| 4,233,698 | 11/1980 | Martin | 4/354 |
| 4,310,934 | 1/1982 | Hennessy et al. | 4/321 |
| 4,407,025 | 10/1983 | Hennessy et al. | 4/354 |
| 4,584,726 | 4/1986 | Grills et al. | 4/378 |
| 4,707,868 | 11/1987 | Hennessy | 4/362 |
| 4,955,921 | 9/1990 | Basile et al. | 4/354 |
| 4,984,311 | 1/1991 | Basile et al. | 4/354 |
| 5,027,444 | 7/1991 | Tsals | 4/354 |
| 5,046,201 | 9/1991 | Steinhardt et al. | 4/354 |
| 5,115,521 | 5/1992 | Adamides | 4/354 |
| 5,136,732 | 8/1992 | Andersson | 4/354 |
| 5,343,572 | 9/1994 | Ament | 4/356 |

PRESSURIZED WATER CLOSET FLUSHING SYSTEM

RELATED APPLICATION INFORMATION

This application is a Continuation-in-Part of co-pending U.S. application Ser. No. 08/129,966, filed on Sep. 30, 1993, which is incorporated herein by reference.

BACKGROUND

1. Field of the Invention

This invention relates generally to a flushing mechanism for use in toilet flushing applications. More particularly, the invention relates to a low water volume, pressurized water closet reservoir.

2. Background Art

A typical flushing system includes a tank connected to a toilet bowl. The tank holds approximately three to five gallons of water and is positioned above the level of the bowl. In such a system, flushing of the bowl is achieved by breaking a seal at the bottom of the tank and releasing the water contained within the tank. The weight of the water due to gravity generates a high velocity flow that then carries bowl water and waste into the sewer line.

In this type of system, the weight of the water alone is used to effect the flushing and replenishing of the bowl, and a minimum of three and a half to four gallons of water are typically required to flush the bowl. Because of the heightened concern caused by decreasing water supplies and the consequent need for water conservation measures, there is a trend to replace gravity-fed water closets with pressurized water closets which utilize a lower volume of water per flush. These pressurized water closets typically have a pressurized reservoir to hold the flush water, and a valve which is actuatable by the user to discharge the pressurized water into the bowl and thereby carry the bowl water into the sewer line. The pressurized water closet of this sort provides a flushing action that is comparable to that which occurs in a gravity-fed water closet, yet it does so by utilizing a much smaller volume of water.

Although pressurized water closets significantly reduce the amount of water used per flush, closets of this type also suffer from several drawbacks. One problem encountered with a pressurized water closet is that the seals used in the pressurized reservoir can deteriorate and fail when the reservoir is overpressurized. Seal failure results in water leaking from the reservoir, which can result not only in significant property damage to floors and walls, but also in the waste of water.

To assist in extending the useful life of pressurized water closets, pressure reducing valves are utilized. The pressure reduction valve is positioned between the water supply and intake port of the pressurized reservoir. This reduces the pressure of the water entering the reservoir. As a result, the components of the flushing mechanism and seals of the reservoir are spared some of the wear typically experienced under higher-pressure use.

The use of pressure-limiting valves on the intake line of the water entering the water closet has, however, led to a related problem. The same deterioration occurring within the water closet seals, also can occur within the pressure-limiting valve and eventually the pressure-limiting valve may break down allowing excessive pressure to build up within the pressurized reservoir. If this occurs, the higher pressure may also eventually break down the seals in the pressurized reservoir causing the reservoir to leak.

Alternative mechanisms to reduce excess pressure within the reservoir have also been proposed. One such mechanism will automatically sense the presence of excessive pressure within the reservoir, and then relieve the pressure by releasing water into the bowl. Although this approach insures that the reservoir is never subjected to excessive pressures, it does so by continuously discharging water. Thus, the approach may not be satisfactory in areas where water conservation is a concern.

OBJECTS AND BRIEF SUMMARY OF THE INVENTION

The present invention has been developed in response to the present state of the art, and in particular, in response to the problems and needs in the art not heretofore fully or completely solved by currently available water closet flushing systems. Thus, it is an overall object of the present invention to provide an improved flushing system.

It is another object of the present invention to provide a flushing system which utilizes a pressurized water closet system that requires a minimal amount of water to effect a flushing operation.

It is a further object of the present invention to provide a pressurized water closet system which is sized and configured so that it can be installed in an existing conventional water closet.

Yet another object of the present invention is to provide a pressurized water closet system which prevents water from leaking from the existing water closet in the event of a ruptured or broken water line.

Another object of the present invention is to provide a pressurized water closet system which has an adjustable water inlet mechanism which allows for the reservoir to be filled with a predetermined amount of water from a water source, and which further prevents water from inadvertently re-entering the water source from the reservoir.

It is yet another object of the present invention to provide a pressurized water closet system which has a mechanism to relieve excess pressure within the pressurized reservoir so as to prevent water leakage therefrom.

Another object of the present invention is to provide a pressurized water closet system which has a mechanism to relieve excess pressure within the pressurized reservoir so as to prevent the pressurized reservoir from rupturing.

It is a further object of the present invention to provide a pressurized water closet system which has a mechanism to release excess air pressure within the pressurized reservoir directly into the bowl of the water closet.

It is yet another object of the present invention to provide a pressurized water closet system which has a mechanism to release excess pressure within the pressurized reservoir into the bowl of the water closet without continuously discharging water. Additional objects and advantages of the invention will be set forth in the description which follows, and in part will be obvious from the description, or may be learned by the practice of the invention. The objects and advantages of the invention may be realized and obtained by means of the instruments and combinations particularly pointed out in the appended claims.

To achieve the foregoing objects, and in accordance with the invention as embodied and broadly described herein, a low volume pressurized water closet reservoir system that can be used alone, or installed and used within an existing water closet is provided. The flushing system includes a sealed, pressurizeable reservoir having an inlet means for introducing water into the reservoir from a source, an outlet means for providing a fluid path from the reservoir to the bowl and a piston means for effecting the opening and closing of the outlet means so as to discharge the pressurized water into the toilet bowl. This flushing operation is initiated by operating the lever portion of a flushing mechanism.

The pressurizeable reservoir includes two pressure zones. The two pressure zones create pressure forces which interact in a manner so as to cause the piston means to open the outlet means during the flushing operation, and to thereafter close the outlet means and await the next flushing operation. Pressure forces within the reservoir also insure that the bowl is filled with a precise amount of water following each flushing operation.

In a preferred embodiment, the flushing system includes means for automatically closing the inlet means once a predetermined amount of water has been introduced into the pressurized reservoir and for preventing fluid in the reservoir from entering the fluid introduction path in the event a negative pressure exists in the fluid introduction path. In addition, the system includes an adjusting means which allows for the adjustment of the closing means so that the amount of water that is introduced into the reservoir after a flushing operation can be easily changed.

The preferred embodiment of the flushing system further includes an overpressure protection means, which automatically releases air from within the reservoir in the event that the pressure exceeds a predetermined limit. This insures that the reservoir is not subjected to dangerously high pressures and therefore results in a system that is less subject to leaks and/or reservoir ruptures. Importantly, the overpressure protection means reduces excess pressure by releasing air directly into the bowl, and not by continuously releasing water. This factor further reduces the overall amount of water volume that is required for the operation of the flushing system of the present invention.

BRIEF DESCRIPTION OF THE DRAWINGS

In order to completely understand the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are therefore not to be considered limiting of its scope, the invention will be described with additional specificity and detail through the use of the accompanying drawings in which.

DETAILED DESCRIPTION 0F THE PREFERRED EMBODIMENTS

Figure 1:
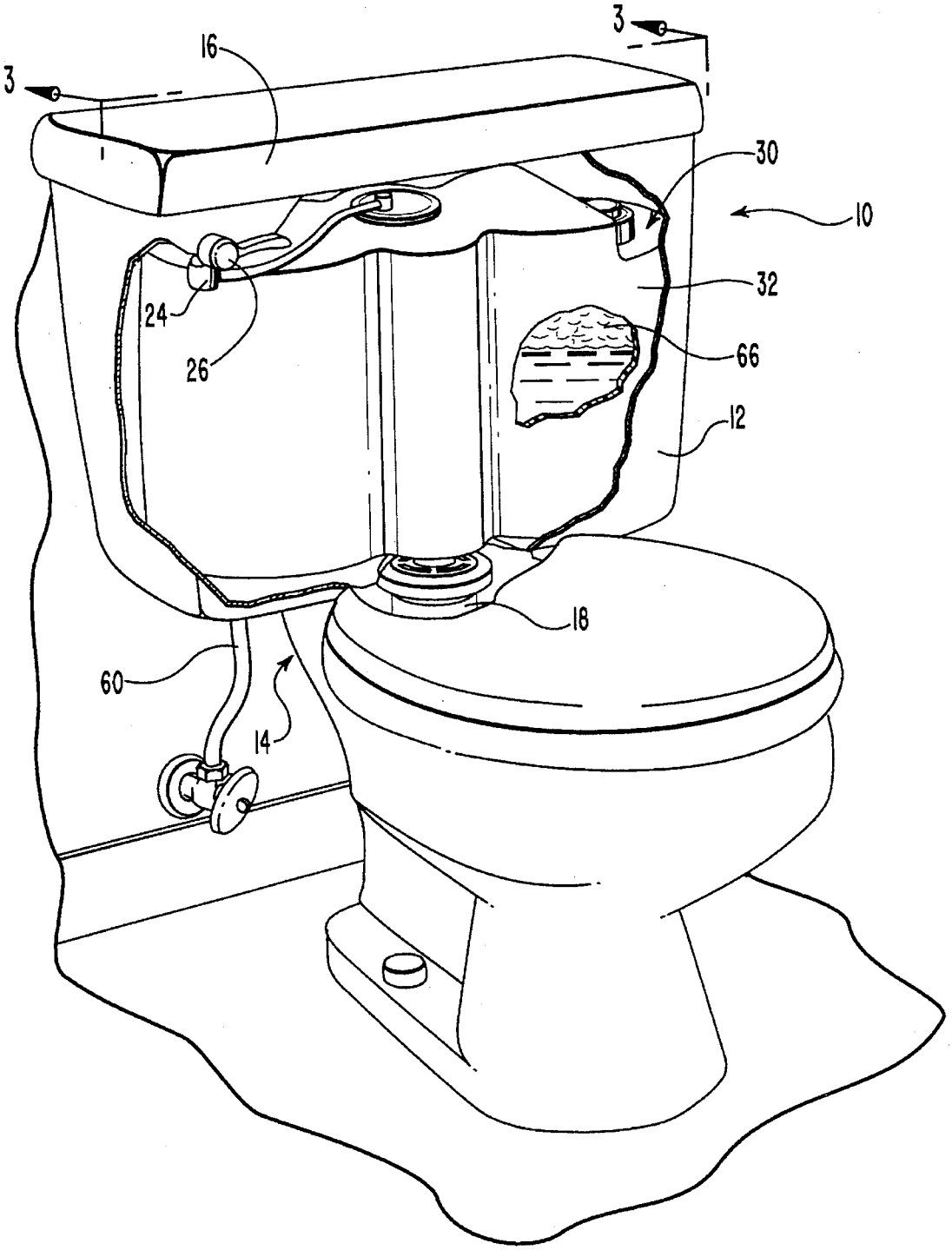
FIG. 1 is a perspective view illustrating a standard tank and bowl having the flushing system of the present invention installed therein.

Referring first to FIG. 1, illustrated is a conventional gravity type water closet 10 of the type currently in use in most residential dwellings. As is well known, in a standard water closet arrangement, a rectangular tank 12 is positioned above the toilet bowl 14 that is to be flushed. The tank is enclosed by a removable cover 16 and at least three conventional apertures. A discharge aperture 18 formed at the bottom of the tank is for allowing water to be discharged from the tank 12 into the toilet bowl 14 during the flushing operation. A second sealable aperture 20 (shown in FIG. 2) is also formed in the bottom of the tank, through which passes an inlet line 22 supplying a fluid under pressure, typically water, from a fluid supply source, such as a municipal water supply. Finally, a third aperture 24 is formed through a wall the tank, through which passes a lever 26 for mechanically actuating the flushing operation.

As will be discussed in further detail, the flushing system of the present invention can be installed and operated using an existing tank of the above general type. However, it should also be appreciated that the instant invention can be constructed and used independent of existing installations. Further, water closets typically utilize water to effect the flushing of the bowl 14, and the flushing system of the instant invention can also utilize water to effect the flushing of the bowl. However, any use of the term water is for illustrative purposes only, and it will be appreciated that the instant invention can be used with any one of a variety of fluids.

Figure 2:
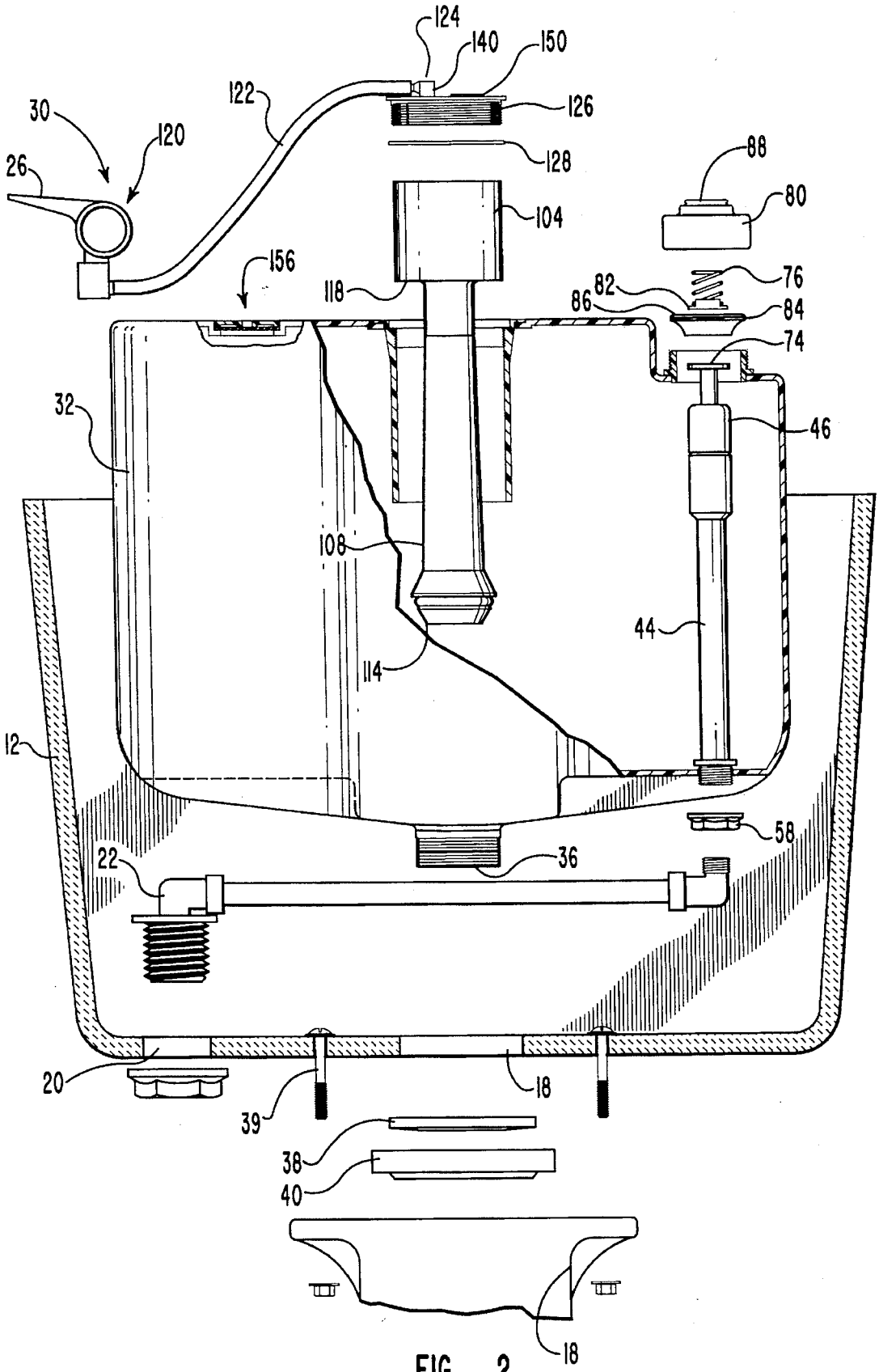
FIG. 2 is an exploded view illustrating each of the components of the flushing system.
Figure 2A:
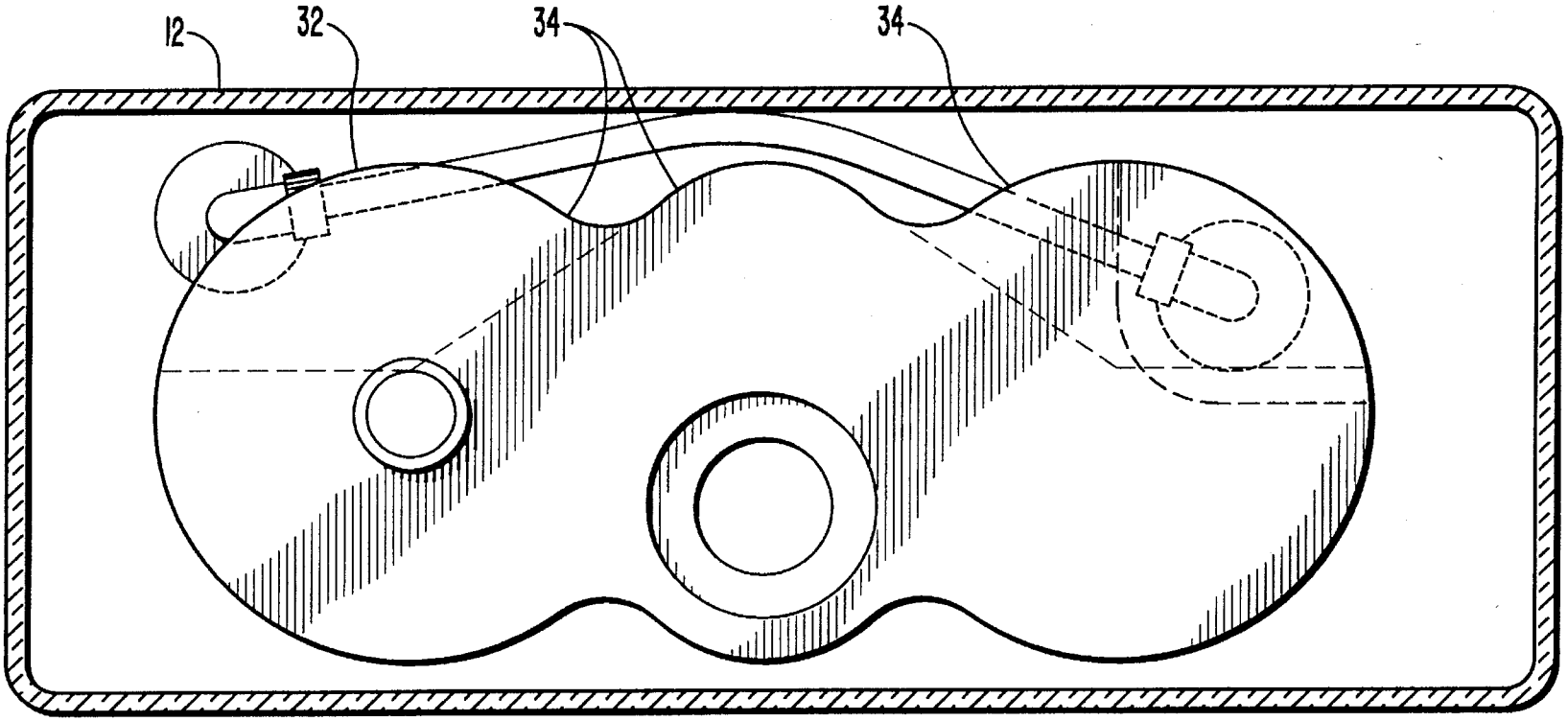
FIG. 2A is a top view of the reservoir in FIG. 2.
Figure 3:
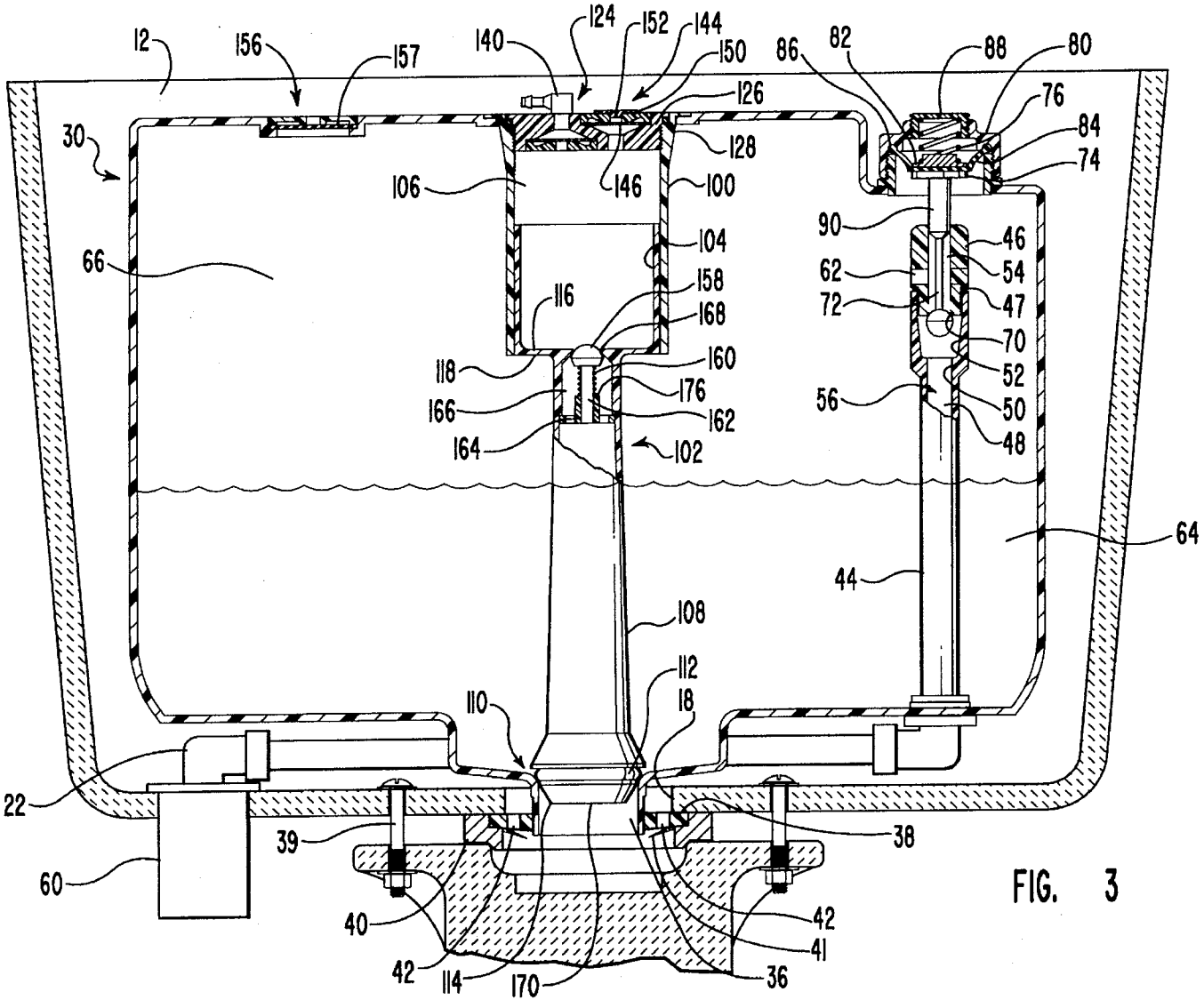
FIG. 3 is a front cross-sectional view taken along lines 3—3 in FIG. 1.

Referring now to FIGS. 2 and 3 together, the flushing system of the present invention, designated generally at 30, is shown. The flushing system 30 includes a substantially pressurizeable closed reservoir 32, which is dimensioned so that it can be readily inserted in and used with existing water closet tanks of the type generally discussed above and illustrated in FIG. 1. As is shown in the top plan view of FIG. 2A, the reservoir 32 preferably has an internal shape having a series of curved portions 34. It has been found by the inventor that this unique shape results in a reservoir 32 that can withstand higher pressures. The reservoir 32 is preferably manufactured, using blow-molding or similar techniques, as a single piece, and is comprised of a high strength plastic or similar material. Because it is fabricated as a single piece, the reservoir 32 does not have the bonded seams or joints that are subject to leakage under high pressures.

Formed through the bottom center portion of reservoir 32 is an outlet means for providing a fluid egress pass from within the reservoir 32 into the bowl 14, as for example the downwardly extending exit aperture 36. It is through this fluid egress path that a fluid is flushed under pressure from the reservoir 32 and into the bowl 14. It will be appreciated that any suitable fluid communication link between the reservoir 32 and bowl 14 is structurally equivalent to exit aperture 36, and within the scope of the invention.

As is shown, the cylindrical outer periphery of the exit aperture 36 is sized so that it can pass through the discharge aperture 18 of an existing tank 12. The outer periphery of the exit aperture 36 is threaded, thereby allowing the reservoir 32 to be threadedly attached to the existing tank 12 via a tank nut 38. The tank 12 is then fastened to the bowl 14 with bolts 39, and a fluid tight seal is formed by placing a tank gasket safety seal 40 therebetween. As can be seen in FIG. 3, the tank nut 38 fits coextensively within the tank gasket 40.

Figure 3A:
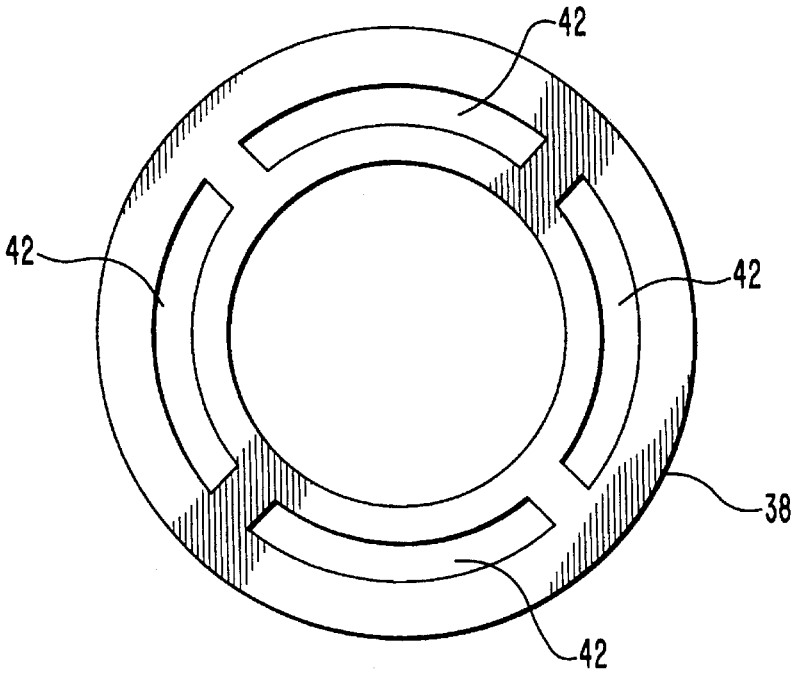
FIG. 3A is a top plan view of the tank nut illustrated in FIGS. 2 and 3.

Preferably, tank nut 38 includes a means for draining fluid into the bowl 12, as for example the series of slits 42 formed through the nut 38, best seen FIG. 3A. Thus, in the event that fluid inadvertently leaks into the tank 12, the fluid will harmlessly pass from the tank 12 through the slits 42 and directly into the bowl 12. This is shown by way of the flow arrows in FIG. 3B. This feature prevents fluid leaking from the reservoir and/or the tank and thus minimizes the risk of damaging the surrounding floor and walls.

Figure 3D:
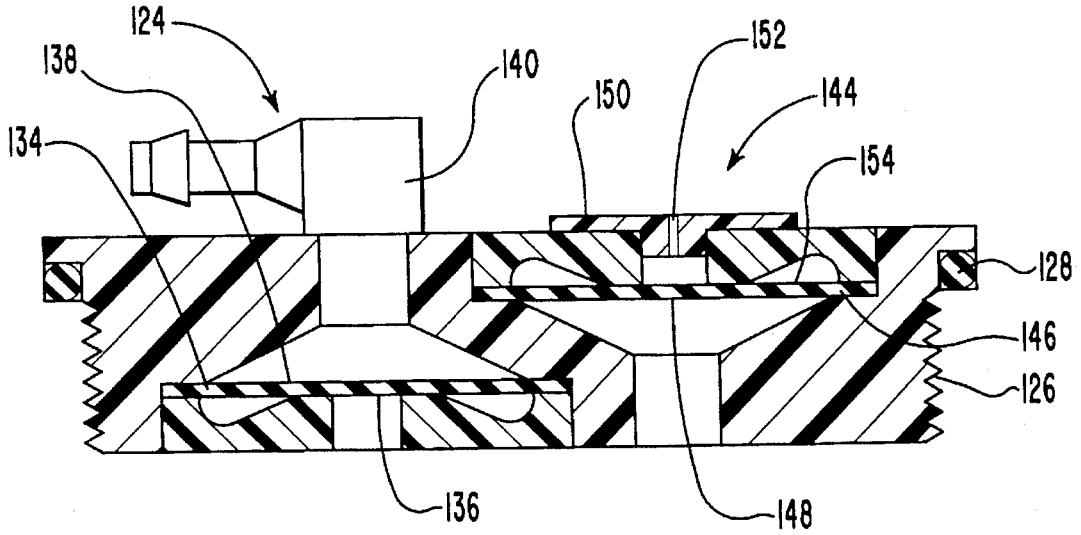
FIG. 3D is an enlarged cross-sectional view illustrating some of the components of FIG. 3 in further detail.
Figure 3B:
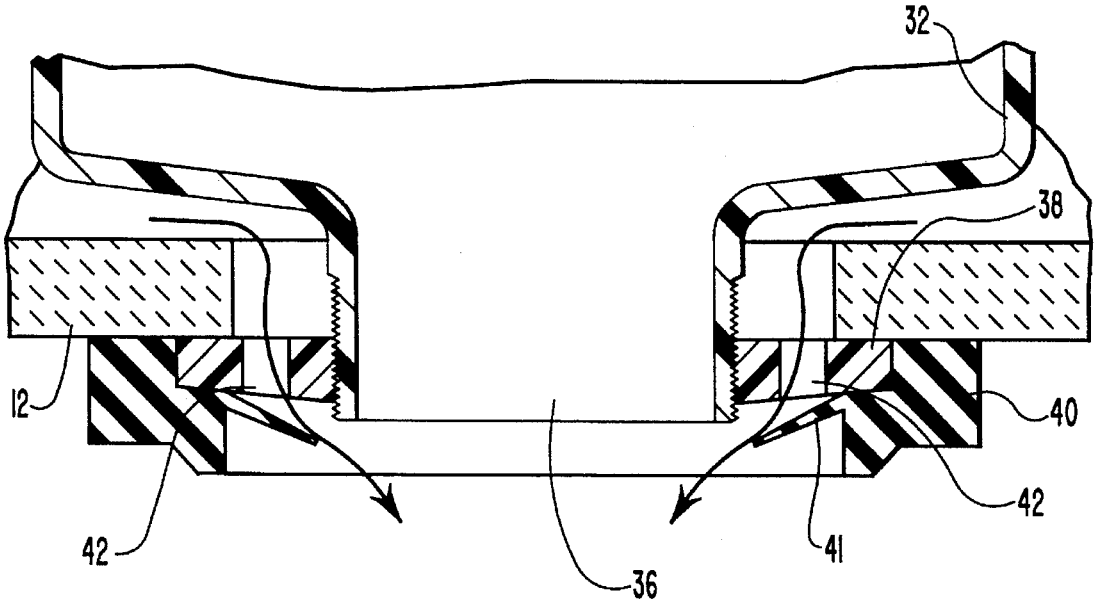
FIG. 3B is a side cross-sectional view of the tank nut and safety seal, taken along lines 3—3 in FIG. 1, illustrating the manner by which water is passed from the tank to the bowl.
Figure 3C:
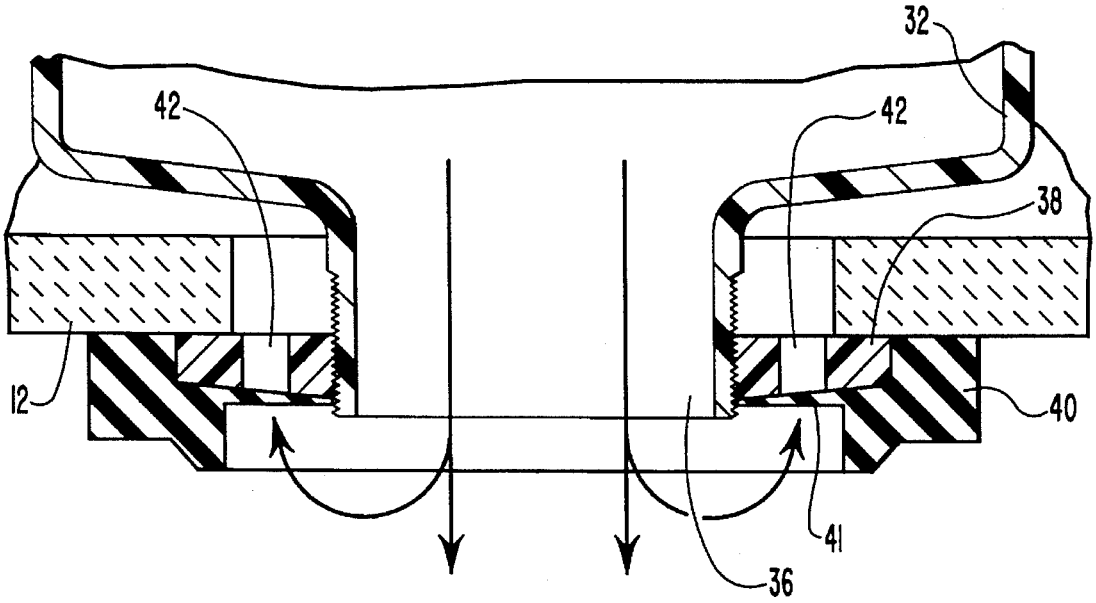
FIG. 3C is a side cross-sectional view of the tank nut and safety seal illustrating the manner by which water is prevented from being passed from the bowl to the reservoir.

Preferably, the safety seal 40 is also comprised of a means for preventing fluid from entering the tank 12. Referring to FIGS. 3B and 3C, one example of a prevention means is an elastomeric flap 41 formed around the inner periphery of the safety seal 40. In a normal position the flap 41 extends downwardly, as is shown in FIG. 3B, so as to permit fluid to pass through the slits 42. However, during a flushing operation, pressurized water is discharged through the exit aperture 36, and the resultant backpressure causes the flap 41 to seal the slits 42, thereby preventing fluid from reentering the tank 12. This is best shown by the flow arrows in FIG. 3C.

Figure 4:
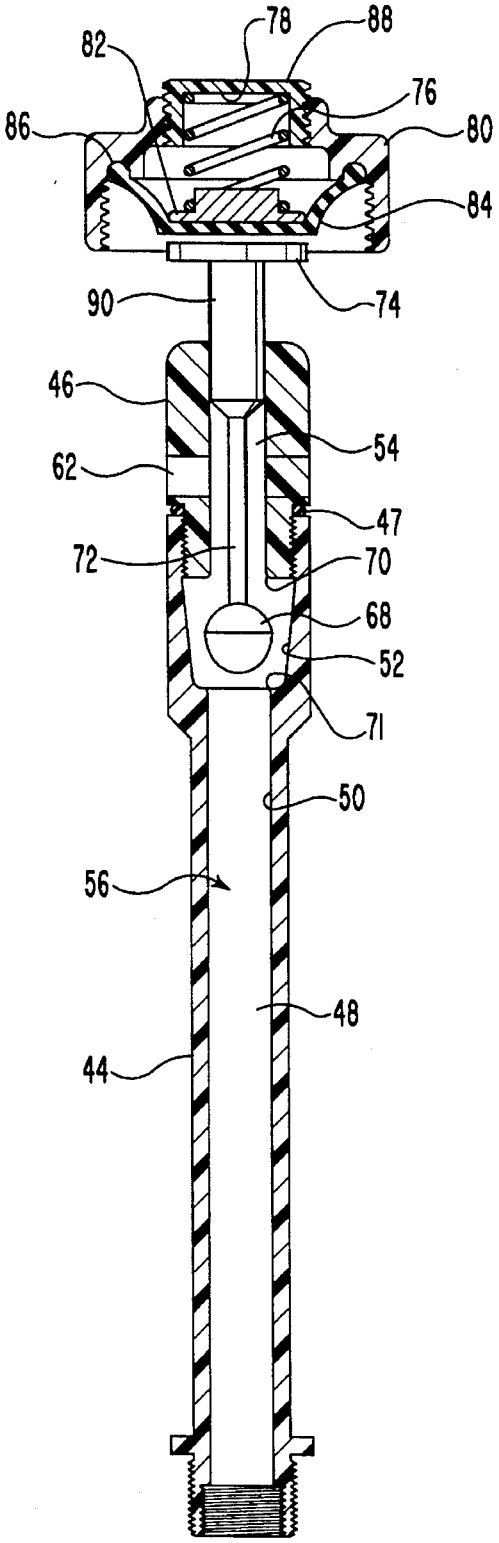
FIG. 4 is an enlarged cross-sectional view illustrating some of the components of FIG. 3 in further detail.

With continued reference to FIGS. 2, 3 and 4 together, the reservoir 32 further includes an inlet means for providing a fluid introduction path from a fluid supply source into the reservoir 32. By way of example and not limitation, the inlet means utilized in the embodiment illustrated in FIGS. 2 and 3 comprises a riser pipe 44 and guide cap 46. Riser pipe 44 has formed therein a bore 48, which has a first diameter 50 and a slightly larger second diameter 52 located at the top of the pipe 44. Threadedly attached to the top of the riser pipe 44 is a guide cap 46. The threaded attachment is made fluid tight by way of an O-Ring 47. Guide cap 46 has a guide bore 54 formed therein, which is in fluid communication with bore 48 and which has a diameter that is smaller than the second diameter portion of bore 48. Formed through a side of the guide cap 46 is an outlet aperture 62 opening into the reservoir 32, and which also is in fluid communication with the guide bore 54 and bore 48.

The bottom end of the riser pipe 44 extends through a hole formed in the reservoir 32, and is threaded so as to be coupled, via a nut 58, to a water inlet line 22, such as that which is typically present in a conventional water closet. The water inlet line 22 is in turn coupled to a fluid supply source, such as a standard water supply line 60. Thus, the bore 48 of riser pipe 44 together with guide bore 54 and outlet aperture 62 form a fluid introduction path, designated generally at 56, from the fluid supply source and into the reservoir 32.

With continued reference to FIG. 3, as fluid, such as water 64, is introduced into the reservoir 32, a main pressure zone 66 above the water level is created. The amount of water 64 introduced into the reservoir 32 dictates the amount of pressure that is present in the pressure zone 66. To regulate the amount of water introduced into the reservoir 32, and thus the amount of pressure that is present in the pressure zone 66, the flushing system 30 includes a means for closing the fluid introduction path 56 once a predetermined amount of fluid has been introduced into the reservoir 32. The closing means simultaneously functions as a backflow prevention, and prevents fluid in the reservoir 32 from entering the fluid introduction path 56 in the event that a negative pressure exists in the fluid introduction path 56.

By way of example and not limitation, FIGS. 3 and 4 together illustrate one preferred embodiment of the closing means as comprising a plug member 68, plug actuation arm 72, a first biasing means for urging the plug actuation arm 72 in a downward direction so as to place the plug member 68 in an open position, such as spring 76; and a second biasing means for acting against the compressive force of spring 76 and thereby allowing the plug arm 72 to move into a closed position when there is a predetermined amount of pressure within the reservoir 32.

Figure 4C:
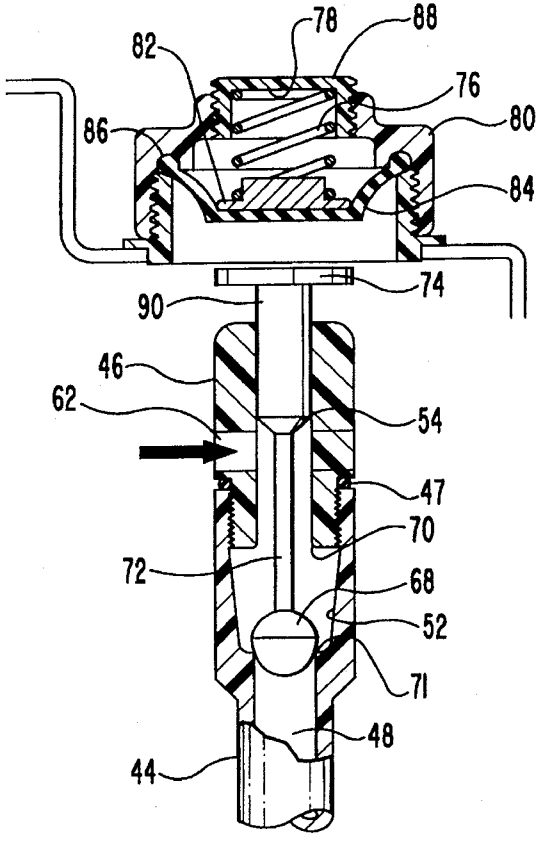
FIGS. 4A through 4C illustrate the various modes of operation of the component illustrated in FIG. 4.
Figure 4B:
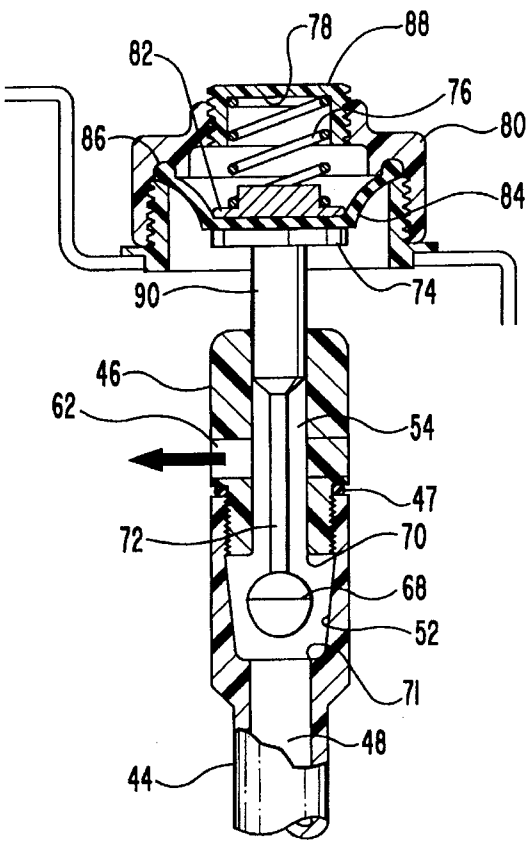
Figure 4A:
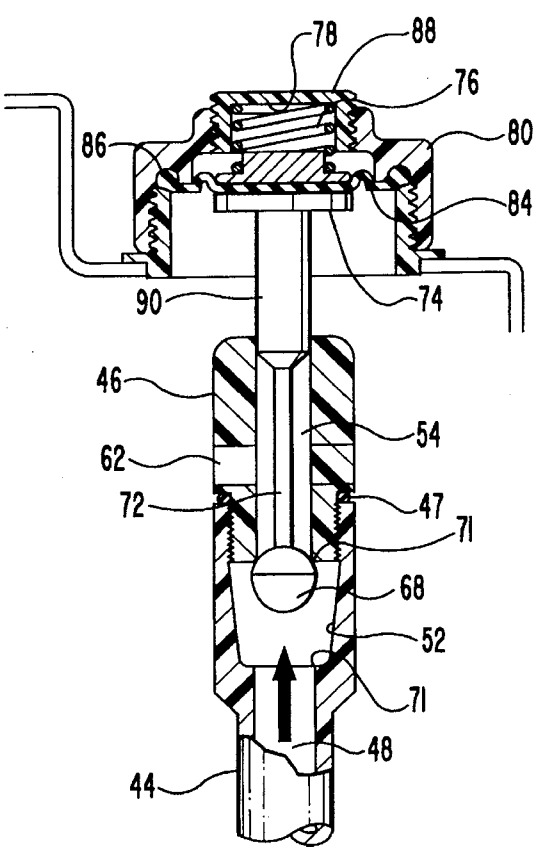

In the preferred embodiment, plug member 68 is substantially round in shape and is formed from an elastomeric material. Plug member 68 is sized so as to fit freely within the second diameter portion 52 of bore 48 in a manner such that fluid can freely pass by the plug member 68, into the guide bore 54 and out the outlet aperture 62 into the reservoir. This corresponds to an open position, and is shown in FIG. 4. The diameter of plug member 68 is sufficiently large so as to be capable of sealing the entrance 70 to the guide bore 54 formed within the guide cap 46 and thereby prevent fluid from entering the reservoir 32. This corresponds to a closed position, which is shown in FIG. 4A.

Connected to the plug member 68 is a plug actuation arm 72. Actuation arm 72 extends completely through the guide bore 54, but is sized such that fluid can pass through the guide bore 54 and into the reservoir 32 when the plug member 68 is in an open position. Connected to the top end of the plug actuation arm 72 is a horizontal flange 74. Movement of the plug member 68 between the open and closed positions is thus accomplished via movement of the plug actuation arm 72.

Urging the plug actuation arm 72 in a downward direction so as to place the plug member 68 in an open position is a first biasing means, which for example is comprised of spring 76. The top end 78 of spring 76 is affixed to a cap 80 that is threadedly affixed to the top of the reservoir 32. The bottom end of the spring 76 is affixed to a spring plate 82 which is aligned with, and capable of contacting the diaphragm 84 which in turn contacts flange 74 portion of the plug actuation arm 72. The compressive force of the spring 76 thus exerts a downward force against the plug actuation arm 72 and urges the plug member 68 away from the entrance 70 to the guide bore 54, thereby opening the fluid introduction path 56. The resulting position of the plug member 68 is shown in FIG. 4B.

Diaphragm 84 is affixed along its outer periphery 86 to cap 80, and it is positioned directly between the spring plate 82 and the flange 74. The diaphragm 84 is responsive to the pressure within the main pressure zone 66, and thus functions so as to allow the plug actuation arm 72 to extend upwardly and into a closed position by acting against the downward compressive force of spring 76.

Thus, as pressure within zone 66 increases, it will act against diaphragm 84 which will counteract against the biasing force of the spring 76 and thus tend to move the actuation arm 72 in an upward direction. This in turn will move the plug member 68 into a sealed engagement with the entrance 70 to the guide bore 54 and thereby close the fluid introduction path 56. The resulting position of the plug member 68 is shown in FIG. 4A.

Operation of the spring 76 and the diaphragm 84 together act so that once a predetermined amount of fluid, such as water 64, is introduced into the reservoir 32, the plug member 68 will be moved to the closed position. In operation, when a flushing operation has been completed and the reservoir 32 is empty, there is little or no positive pressure present within pressure zone 66. In this state, there is no pressure forced exerted on diaphragm 84, and the downward biasing force of spring 76 is such that the plug member 68 is in an open position (FIG. 4B). As such, water under pressure is introduced into the reservoir 32 through the fluid introduction path 56. As water 64 is introduced into the reservoir 32, pressure zone 66 is created, and the positive pressure within zone 66 increases as the volume of water 64 increases.

Once a predetermined amount of water 64 has been introduced into the reservoir 32, pressure within pressure zone 66 will be sufficiently high so that a closing force is being exerted on diaphragm 84. This closing force, which acts together with the water pressure force being exerted against the plug member 68 (which also tends to move the plug 68 into a closed position), overcomes the biasing force of the spring 76 and moves the plug member 68 into a closed position (FIG. 4A). The plug 68 will remain in the closed position until there is a pressure drop in the reservoir 32, as for instance after a flushing operation.

In a preferred embodiment, the closing force sufficient to effect the closing of the fluid introduction path 56 is approximately eleven pounds per square inch (psi), which corresponds to approximately 1.2 gallons of water present within the reservoir 32.

As mentioned, the closing means also functions as a backflow prevention, for preventing fluid in the reservoir 32 from entering the fluid introduction path 56 in the event a negative pressure exists in the fluid introduction path 56. This insures that water contained within the reservoir 32 does not inadvertently enter the water supply line 60. As is shown in FIG. 4C, in the event a negative pressure exists within bore 48, the resulting suction will cause the plug arm 72 to fall downwardly. The plug member 68 then seats in a fluid tight manner, within bore opening 71, and closes the fluid introduction path 56. This prevents fluid from exiting the reservoir 32 due to the negative pressure.

It will be appreciated that in the preferred embodiment, the predetermined amount of water 64 (or other fluid) that is introduced into the reservoir 32 is dependent on the biasing force that is exerted by spring 76 on plug actuation arm 72. A smaller spring force will result in a lower water level, while a higher spring force will result in a higher water level. Since it may be desirable to select or vary the amount of water that is introduced into the reservoir 32 after a flushing operation, the flushing system 30 of the present invention preferably comprises a means for adjusting the closing means so as to select the predetermined amount of fluid that is to be introduced into the reservoir 32 through the fluid introduction path 56.

By way of example and not limitation, the adjusting means comprises an adjusting screw cap 88 that is threadedly received within the top of the cap 80, best seen in FIG. 4. The top end 78 of spring 76 is placed against the screw cap 88. Rotation of the adjusting screw cap 88 will thus result in the an upward or downward movement of the screw cap 88, and will thereby compress or extend the spring 76 so that the biasing force exerted on the plug actuation arm 72 is correspondingly increased or decreased. In this way, the user can select the amount of water that is to be introduced into the reservoir 32 after each flushing operation. It will be appreciated that the adjusting means could also be implemented with other equivalent structures that permit for the adjustment of the biasing force that is exerted on the actuation arm 72.

Referring again to FIGS. 2 and 3 together, the manner by which fluid in the reservoir 32 is discharged through the exit aperture 36 so as to effect a flushing of the bowl 14 will now be described. Extending downwardly from the top interior surface of the reservoir 32 is a cylindrically shaped, hollow cylinder 100. Hollow cylinder 100 is positioned within the reservoir 32 so as to be oriented directly above the exit aperture 36. Movably disposed within the reservoir 32 is a piston means for effecting the opening and closing of the fluid egress path defined by the exit aperture 36. The piston means is comprised, for example, of an elongate piston member, designated generally at 102, also shown in FIG. 5. Piston member 102 comprises a cylindrically shaped hollow cup 104, and an elongate plunger 108.

As can be seen in FIG. 3, the hollow cup 104 portion of piston 102 is movably received in a tight fitting fashion within hollow cylinder 100. Importantly however, the fit is not fluid tight, and it is such that pressurized air can slowly pass from the main pressure zone 66 to a secondary pressure zone 106 that is formed within cup 104 and hollow cylinder 100.

Connected to the bottom of hollow cup 104 is the elongate plunger 108. Plunger 108 is circular in cross-section, and is tapered along its length so as to form an expanded bottom end. This bottom end portion is contoured so as to form a plug 110 which is capable of closing, in a fluid tight manner, the exit aperture 36. To insure a fluid tight seal, preferably an O-ring 112 or other similar sealing means is provided around the circumference of the plug 110. Also, to further facilitate and insure proper closing of exit aperture 36, the distal end 114 of plunger 108 is downwardly tapered. This tapered shape functions as a guide means and helps insure that the plug 110 portion of plunger 108 securely seats in a fluid tight manner within the exit aperture 36.

When piston member 102 is downwardly extended within the reservoir 32, as is shown in FIG. 3, the plug 110 seals the exit aperture 36 and thereby prevents fluid from being discharged into the bowl 14. Conversely, in an upwardly extended position, plug 110 is retracted from the exit aperture 36, thereby opening it, and fluid is discharged through the exit aperture 36 so as to effect a flushing of the bowl 14.

With continued reference to FIG. 3, the movement of the piston member 54 between the open and the closed positions is effected by pressure differentials that are present within the reservoir 32. When the piston member 102 is positioned such that the exit aperture 36 is closed by plug 110, the pressurizeable reservoir 32 can be filled with a fluid, such as water, through outlet aperture 62, as generally discussed above. As was also discussed, as the water is introduced into the reservoir 32, pressure within main pressure zone 66 increases. This pressure is also eventually communicated to the secondary pressure zone 106 due to the non-fluid tight fit between the cup 104 and the hollow cylinder 100 so that the pressure within zones 66 and 106 are eventually approximately equal.

In this state, the weight of the piston member 102, together with downward force exerted on the interior bottom surface 116 of the cup 104 that results from the pressure contained with the secondary pressure zone 106, acts to keep the plug 110 in a sealed relationship with the exit aperture 36. Normally, since the reservoir 32 is usually holding some water, the piston member 102 will be in this downwardly extended, closed position. It is only during, and for a short time following, a flushing operation that the piston member 102 will extend upwardly and open the exit aperture 36.

To effect the flushing operation, the secondary pressure zone 106 is exposed to atmospheric pressure, thereby reducing the pressure within zone 106. Because there is a sudden decrease in pressure within zone 106, and a coincident reduction of force being applied to the interior bottom surface 116 of the cup 104, the force exerted on the exterior bottom surface 118 of cup 104 (caused by the pressure still present within main pressure zone 66) causes the cup 104, together with the plunger 108, to move upwardly within hollow cylinder 100. This upward movement removes the plug 110 from the exit aperture 36, and allows water contained within the reservoir 32 to be discharged under pressure through the exit aperture 36, thereby effecting the flushing of the bowl 14.

Functionally, the secondary pressure zone 106 is exposed to atmospheric pressure by way of a release means. By way of example, in the preferred embodiment illustrated in FIG. 2 the release means is comprised of a discharge assembly, designated generally at 120, and a one-way valve, designated generally at 124, which are then operatively coupled by way of a tube 122. One-way valve 124 is fitted on a cap 126 that is threadedly attached to the top of the reservoir 32 and further sealed in a fluid tight manner by way of a rubber O-Ring 128. As can best be seen in FIG. 3D, valve 124 is comprised of a diaphragm 134, the bottom side 136 of which is in communication with the secondary pressure zone 106. Formed on the top side 138 of the diaphragm 134 is a fitting 140 which is coupled to the tube 122.

The top side 138 of the diaphragm 134 is exposed to atmospheric pressure by depressing the lever 26 portion of the discharge assembly 120, which is positioned on the exterior of the tank 12. The resulting pressure differential between the top and bottom sides 138, 136 causes an aperture (not shown) in the diaphragm 134 to open, thereby exposing the secondary pressure zone 106 to the atmospheric pressure. This results in the flushing operation described above.

Once the flushing operation has been initiated by depressing the lever 26 and the piston member 102 opens the exit aperture 36 so as to discharge the pressurized water into the bowl 14, water will be introduced into the reservoir 32 via the fluid introduction path 56, as described above. It will be appreciated that the piston member 102 must remain in this open position for a time sufficient to permit water to pass through and fill the toilet bowl 14 after the flushing operation. The rate at which the piston member 102 remains in the open position is controlled by a regulator means for allowing a predetermined amount of air into the secondary pressure zone. By way of example, the regulator means is comprised of a second one-way valve assembly, designated generally at 144, which is also positioned on the cap 126. The second one-way valve assembly 144, best seen in FIG. 3D, comprises a diaphragm 146, the bottom side 148 of which is in communication with the secondary pressure zone 106. The second one-way valve assembly 144 further includes an adjustment means for selecting the amount of air that is to be introduced into the secondary pressure zone 106. The adjustment means comprises, for example, an adjustable speed disk 150 which has an aperture 152, the size of which can be adjusted by rotating the disk 150. This aperture 152 communicates atmospheric pressure with the top side 154 of diaphragm 146.

In operation, after the pressure within secondary pressure zone 106 is reduced and the flushing operation is complete, the rate at which the piston member 102 will fall downwardly (due to gravitational forces) and into the closed position is proportional to the rate by which air is introduced into the pressure zone 106 through an aperture (not shown) formed in diaphragm 146. This rate of air flow is in turn dictated by the opening size of the adjustable aperture 152 that is formed in disk 150. A larger sized aperture 152 opening will result in a quicker return to a closed position, and thereby less water will be introduced into the bowl 14. Conversely, a smaller sized aperture 152 opening will have the opposite effect.

Referring again to FIGS. 2 and 3, following a flushing operation, pressure within the reservoir may go to a negative level, which could effect the proper operation of the system 30. As such, the flushing system 30 is preferably comprised of a breaker means for introducing air into the reservoir when a negative pressure exists in the reservoir. By way of example, and not limitation, breaker means is comprised of a one-way breaker valve, designated generally at 156. Breaker valve 156 has a diaphragm 157 that will open an aperture formed therein (not shown) and let air into the reservoir 32 only while a negative pressure exists within the reservoir 32.

Once a flushing operation is complete, the piston member 102 will descend and ultimately return to a closed position wherein plug 110 seals exit aperture 36. Water will then continue to be introduced until there is a sufficient pressure and corresponding water level within the reservoir 32, at which time the fluid introduction path 56 will be closed, in the manner already described. To insure the overall safety and integrity of the flushing system 30, the system further includes an overpressure protection means for releasing air from within the reservoir 32 into the bowl 14 when the air pressure within the reservoir exceeds a predetermined limit. Importantly, this excess air is released directly into the bowl 14, and it is done in a manner such that water is not continuously released into the bowl 14.

Figure 5:
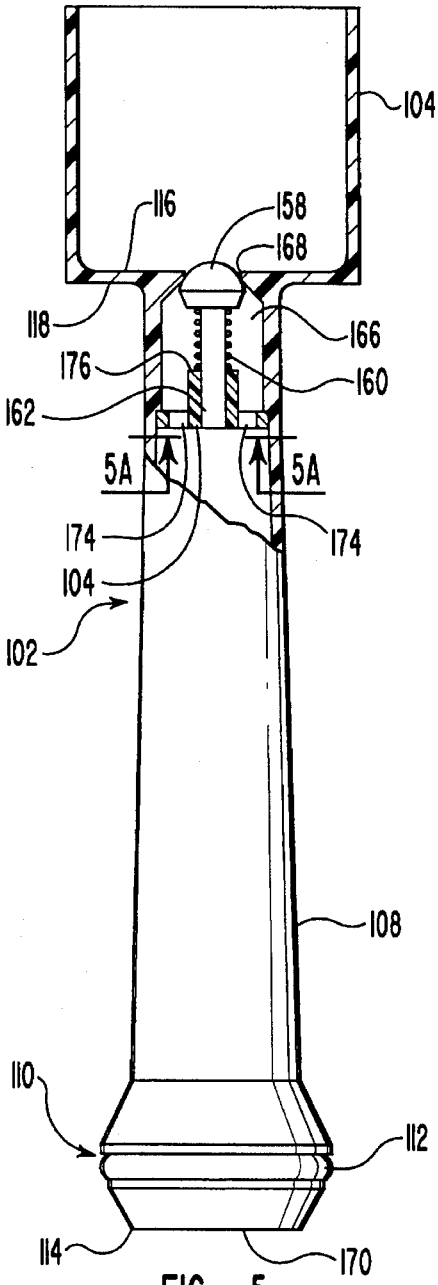
FIG. 5 is an enlarged cross-sectional view illustrating some of the components of FIG. 3 in further detail.

Referring now to FIGS. 3 and 5 together, one example of the overpressure protection means is shown as comprising a means for closing and opening an air passageway 166 formed within piston member 102, such as air plug 158; a means for biasing the air plug 158 into a closed position while the air pressure within the reservoir 32 is below a predetermined maximum limit, such as spring 160; a guide member 162 and a guide 164.

As FIG. 5 further illustrates, the elongate plunger 108 and plug 110 portions of piston member 102 have a hollow air passageway 166 formed therein. The top portion of the air passageway 166 is in communication with the interior of cup 104 via an air aperture 168. Similarly, there is an air discharge aperture 170 formed through the bottom of the plug 110 end of plunger 108 at the opposite end of the air passageway 166. Thus, when the piston member 102 is in a closed position, pressurized air can enter the air passageway 166 via the air aperture 168, and will then be expressed through the air discharge aperture 170 and directly into the bowl 14.

Figure 5A:
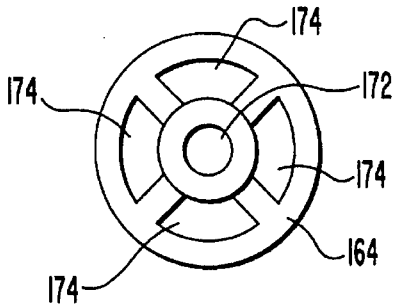
FIG. 5A is a top plan view of the guide component illustrated in FIG. 5.

To prevent air from constantly being discharged, air plug 158 is sized and shaped so as to fit within the air aperture 168 in an air tight manner. Attached to the bottom of the air plug 158 is a cylindrical, elongate guide member 162. The bottom portion of the guide member 162 is slidingly received within a correspondingly shaped bore 172 formed in guide 164 (shown in FIG. 5A). Guide 164 is permanently affixed to the plunger 108 within air passageway 166. As can be seen both in FIGS. 5 and 5A, the guide 164 has formed therethrough a series of air slots 174.

Disposed around the guide member 162 and positioned between the air plug 158 and guide 164 is spring 160. The base portion of the spring 160 rests on a shoulder portion 176 of the guide 164 so that the biasing force of the spring 160 is urged upwardly against the air plug 158, thereby sealing the air aperture 168.

In operation, as air pressure within the main pressure zone 66 increases, it is communicated to the secondary pressure zone 106. As mentioned, the preferable operating pressure is approximately 11 p.s.i. Under these conditions, the biasing force of spring 160 is such that the air plug 158 is maintained in the closed, air-tight position. However, if pressure within the reservoir 32 begins to exceed a predetermined maximum, such as for example 12 p.s.i., the resultant pressure forces exerted on the air plug 158 will exceed the closing force exerted by the spring 160. As such, the air plug 158 and guide member 162 will move so as to open the air outlet aperture 170. Excess pressurized air will thus escape from the reservoir 32, enter the air passageway 166, pass through the series of air slots 174, and exit the air discharge aperture 170 into the bowl 14.

When the air pressure within the secondary pressure zone 106 drops because of the above release of pressure, the piston member 102 will move upwardly within the hollow cylinder 100, thereby opening the exit aperture 36. As already discussed, this results in a flushing action. This process of releasing pressure within the reservoir will continue until the air pressure within the reservoir 32 returns to a normal magnitude, at which time the spring 160 will move the air plug 158 back into the closed position.

As will be appreciated, the above overpressure protection structure eliminates problems that may occur with overpressurization of reservoir 32. For example, by eliminating overpressure situations, there is a reduced likelihood for the reservoir to fail or to develop leaks. Further, rather than continuously releasing water into the bowl to relieve pressure, air is released. This reduces the volume of water that is used by the flushing system 30 by a substantial amount over a period of time. This is especially important in those areas where water is scarce and conservation important. Further, the release of air pressure into the bowl 14 advantageously results in an audible indication of the overpressure situation that exists within the system, which can then be fixed in a timely manner.

The present invention may be embodied in other specific forms without departing from its spirit or essential characteristics. The described embodiments are to be considered in all respects only as illustrative and not restrictive.

What is claimed and desired to be secured by United States Patent is:

1. A flushing apparatus for flushing a bowl with a fluid under pressure, the flushing apparatus comprising:

a pressurizable reservoir adapted to house the fluid and an overlying pocket of air, the pocket of air defining a primary pressure zone;

a housing positioned within the reservoir and having a secondary pressure zone formed therein;

inlet means for providing a fluid introduction path from a fluid supply source into the reservoir;

outlet means for providing a fluid egress path from within the reservoir into the bowl;

piston means, movably disposed within the reservoir, for effecting the opening and closing of the fluid egress path; and overpressure protection means for releasing air from within the reservoir into the bowl through the outlet means when air pressure within the reservoir exceeds a predetermined limit.

2. A flushing apparatus as defined in claim 1, further comprising means for closing the fluid introduction path once a predetermined amount of fluid has been introduced into the reservoir, and for preventing fluid in the reservoir from entering the fluid introduction path in the event a negative pressure exists in the fluid introduction path.

3. A flushing apparatus as defined in claim 2, wherein the closing means comprises:

a plug member disposed within the fluid introduction path;

first biasing means for urging the plug member into an open position within said fluid introduction path when said predetermined amount of fluid has not yet been introduced into the reservoir, thereby allowing fluid into the reservoir; and second biasing means for acting against the first biasing means so as to allow the plug member to move into a closed position within said fluid introduction path when said predetermined amount of fluid has been introduced into the reservoir, thereby preventing fluid from entering the reservoir.

4. A flushing apparatus as defined in claim 2, further comprising means for adjusting the closing means so as to select the predetermined amount of fluid that is to be introduced into the reservoir through the fluid introduction path.

5. A flushing apparatus as defined in claim 4, wherein the adjusting means comprises a threaded screw cap, the screw cap extending through a wall of the reservoir so as to be in threaded engagement therewith and so as to be positioned against the closing means, whereby rotation of the screw cap in a first direction increases said predetermined amount of fluid to be introduced, and rotation of the screw cap in a second direction decreases said predetermined amount of fluid to be introduced.

6. A flushing apparatus as defined in claim 1, wherein the reservoir is sized and configured so as to fit within a preexisting water closet tank, the preexisting tank having a discharge aperture in fluid communication with a bowl.

7. A flushing apparatus as defined in claim 6, wherein the reservoir is adapted to be operatively coupled to said preexisting water closet tank with a threaded tank nut, the tank nut comprising means for draining fluid contained within the water closet tank into the bowl.

8. A flushing apparatus as defined in claim 7, wherein the draining means comprises a plurality of slits formed through the tank nut, the slits each forming a fluid communication path from said preexisting water closet tank into said discharge aperture, whereby fluid contained within said tank drains into said bowl.

9. A flushing apparatus as defined in claim 8, further comprising a tank gasket safety seal adapted to be placed between the preexisting water closet tank and the bowl, the safety seal comprising means for preventing fluid from entering the tank through the plurality of slits formed in the tank nut.

10. A flushing apparatus as defined in claim 9, wherein the prevention means comprises an elastomeric flap positioned in a spaced apart manner from the plurality of slits, whereby the flap seals the plurality of slits during a flushing operation.

11. A flushing apparatus as defined in claim 1, further comprising release means for exposing the secondary pressure zone to a predetermined pressure for a predetermined amount of time, the predetermined pressure being less than a pressure contained within said secondary pressure zone, thereby causing said piston means to effect the opening of the fluid egress path so as to flush the bowl with the fluid contained with the reservoir.

12. A flushing apparatus as defined in claim 11, wherein the predetermined pressure is approximately atmospheric pressure.

13. A flushing apparatus as defined in claim 11, wherein the release means comprises:

a discharge lever assembly; and one-way valve means, operatively coupled to the discharge lever assembly, for exposing the secondary pressure zone to the predetermined pressure for the predetermined amount of time while the discharge lever assembly is actuated.

14. A flushing apparatus as defined in claim 1, further comprising regulator means for regulating the amount of air pressure contained within the secondary pressure zone.

15. A flushing apparatus as defined in claim 14, wherein the regulator means comprises:

a one-way valve positioned on said reservoir so as to allow a predetermined amount of air to flow into the secondary pressure zone; and adjustment means for selecting the predetermined amount of air that is to flow into the secondary pressure zone through the one-way valve.

16. A flushing apparatus as defined in claim 1 further comprising breaker means for increasing pressure within the primary pressure zone when a negative pressure condition exists within the primary pressure zone.

17. A flushing apparatus as defined in claim 16, wherein the breaker means comprises a one-way valve positioned on said reservoir so as to allow air to flow into the primary pressure zone when said negative pressure condition exists within the primary pressure zone.

18. A flushing apparatus as defined in claim 1, wherein the underlying housing comprises a hollow cylinder portion, the hollow cylinder extending downwardly so as to positioned over the fluid egress path, and wherein the secondary pressure zone is disposed within the hollow cylinder.

19. A flushing apparatus as defined in claim 1, wherein the piston means comprises:

an elongate piston member having a first and a second end;

a hollow cylindrical cup, formed on the first end of the piston member;

a plug formed on the second end of the piston member, said plug being sized and configured so as to be capable of sealing in a fluid tight manner the fluid egress path; and wherein the elongate piston member slidably moves within the reservoir in response to a pressure differential between the primary pressure zone and the secondary pressure zone.

20. A flushing apparatus as defined in claim 1, wherein the overpressure protection means comprises:

an air passageway formed within the piston means;

obstruction means for providing an open and a closed position within said air passageway, the obstruction means being in the open position when said air pressure within the reservoir is above said predetermined limit thereby allowing air contained within the reservoir to pass through the air passageway and into the bowl; and means for biasing the obstruction means into said closed position when said air pressure within the reservoir is below said predetermined limit, thereby preventing air contained within the reservoir from passing into the air passageway.

21. A flushing apparatus for flushing a bowl with a fluid under pressure, the flushing apparatus comprising:

a pressurizable reservoir;

inlet means for providing a fluid introduction path from a fluid supply source into the reservoir;

closing means for both closing the fluid introduction path once a predetermined amount of fluid has been introduced into the reservoir, and for preventing fluid in the reservoir from entering the fluid introduction path in the event a negative pressure exists in the fluid introduction path;

means for adjusting the closing means so as to select the predetermined amount of fluid that is to be introduced into the reservoir through the fluid introduction path;

outlet means for providing a fluid egress path from within the reservoir into the bowl;

piston means, movably disposed within the reservoir, for effecting the opening and closing of the fluid egress path; and overpressure protection means for releasing air from within the reservoir into the bowl through the outlet means when air pressure within the reservoir exceeds a predetermined limit.

* * * * *